United States Patent [19]

Ellis

[11] 4,092,750

[45] June 6, 1978

[54] INFLATABLE INSULATING APPARATUS

[76] Inventor: Donald G. Ellis, 2315 Broadway, No. 2, Boulder, Colo. 80302

[21] Appl. No.: 686,653

[22] Filed: May 14, 1976

[51] Int. Cl.[2] ..... A47G 9/00

[52] U.S. Cl. ..... 5/343; 5/349; 5/368

[58] Field of Search ..... 5/343, 349, 350, 365, 5/368, 369, 370, 371, 367; 128/303.1, 399; 428/68, 72, 73, 178, 188; 52/2; 160/241; 139/384 R; 61/1 F

[56] References Cited

U.S. PATENT DOCUMENTS

| | | | |
|---|---|---|---|
| 1,733,034 | 10/1929 | Tufenkjian | 5/368 |
| 2,604,641 | 7/1952 | Reed | 5/349 |
| 3,044,515 | 7/1962 | Eades | 52/2 |
| 3,170,172 | 2/1965 | Kessman | 5/368 |
| 3,205,891 | 9/1965 | Achner | 428/188 |
| 3,236,290 | 2/1966 | Lueder | 160/241 |
| 3,612,059 | 10/1971 | Ersek | 128/399 |

*Primary Examiner*—Peter M. Caun

*Attorney, Agent, or Firm*—Price, Heneveld, Huizenga & Cooper

[57] ABSTRACT

The specification discloses an inflatable, insulating apparatus for use as or in a mattress inflatable with a fluid such as air. Included are a fluid-tight envelope and reflective material, preferably thin layers of metallic material, on at least two spaced portions of said apparatus to reflect thermal radiation, such as from a supported living being when the apparatus is used as a mattress, to reduce radiative heat transfer across or through the structure. Either as an alternate insulator, or in combination with the reflective material, one or more baffles may be provided within the apparatus to reduce both free and forced convective heat transfer. In one embodiment, reflective baffles form a honeycomb assembly which is collapsible upon deflation of the structure.

17 Claims, 14 Drawing Figures

INFLATABLE INSULATING APPARATUS

BACKGROUND OF THE INVENTION

This invention relates to structures for insulating a colder surface, area, or object from a warmer surface, area, or object and, more particularly, to an inflatable, insulating apparatus for applications such as in mattresses inflatable with air or another fluid.

It has long been a problem to insulate one surface, area, or object from another surface, area, or object where a temperature differential exists between the two. The problem is especially difficult for campers, hikers, and other outdoorsmen who must sleep outside, often during cold weather. Typically, such persons have utilized air mattresses which may be inflated for use, or foam pads of the closed or open-celled type which may be compressed, rolled, stored, and/or transported for such sleeping. At night, the ground temperature is usually much lower than that of the person's body; and the intermediate air mattress or foam pad may fail to sufficiently limit the transfer of heat from the sleeping person, with resulting discomfort.

In studying the problem, I have discovered that the discomfort caused when sleeping outside on cold ground with conventional mattresses results from the combined effects of thermal radiation from the body of the sleeping person and both free and forced convective heat transfer between the colder ground and the warmer body of the person through the intermediate mattress. Free convection results because of the fluid or air circulation between the opposite surfaces of the intermediate mattress which are at different temperatures. Forced convection arises from displacements of the fluid or air in the mattress due to various movements of the person thereon causing mixing of warmer and cooler air or fluid masses and the movement of air or fluid past mattress surfaces which are at a different temperature than the moving fluid.

In recognition of the above problems and the physical principles which result in those problems, the present invention is designed to overcome the above problems in inflatable air mattresses and in other applications where insulation is required.

SUMMARY OF THE INVENTION

Accordingly, the present invention is an insulating structure which reduces radiative heat transfer through the structure as well as both free and forced convective heat transfer therethrough. The structure is also especially designed to be inflatable and deflatable for ease of storage and transportation. The apparatus may be used as an inflatable mattress which insulates a sleeping person from the colder ground surface on which the insulating apparatus is supported.

In its basic form, the apparatus includes a fluid tight envelope and reflective means included on at least two spaced portions of the apparatus for reflecting a significant portion of any thermal radiation incident thereon to reduce radiative heat transfer through the envelope.

Alternatively, the envelope may include baffle means extending between portions therewithin located to reduce convective heat transfer between opposing portions of the envelope. In one form of the invention, the reflective means are combined with the baffle means as a reflective layer thereon with the baffle means spaced between opposing portions of the envelope. The baffle means may be provided parallel to or at an angle to one another generally intermediate and transverse to the opposing portions of the envelope between which heat transfer is to be reduced or at an angle thereto. In one specific form, the baffle means are interconnected with one another and the envelope to form a honeycomb baffle assembly which is collapsible when the apparatus is deflated.

In other aspects of the invention, the envelope may be formed itself as an inflatable mattress of the box or tufted-type construction. Alternatively, a series of envelopes may be assembled together within a flexible, enclosing cover, each envelope being separately inflatable to prevent deflation of the entire structure should one envelope become punctured or deflated.

Thses and other objects, advantages, purposes, and features of the invention will become more apparent from a study of the following description taken in conjunction with the drawings.

DESCRIPTION OF THE PREFERRED EMBODIMENT

Figure 1:
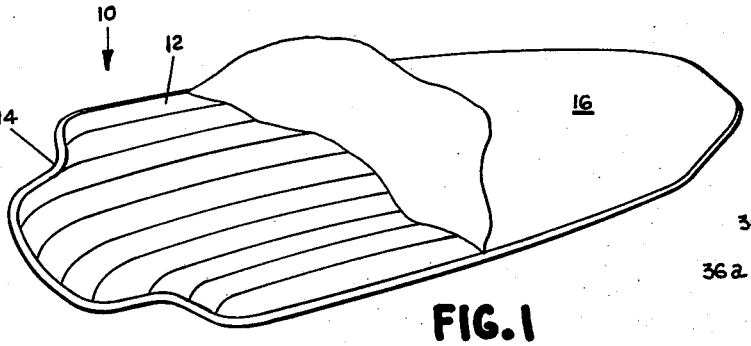
FIG. 1 is a perspective view of an inflatable, insulating air mattress embodying the present invention.

Referring now to the drawings in greater detail, the several figures illustrate various types of fluid inflatable mattresses embodying the present invention. While it will be appreciated that the present invention has many and varied applications as an insulating apparatus, it is specifically described herein with respect to inflatable mattresses as being a primary application for the principles involved. Dimensions in FIGS. 4, 6–10, and 13 have been exaggerated for clarity.

Figure 2:
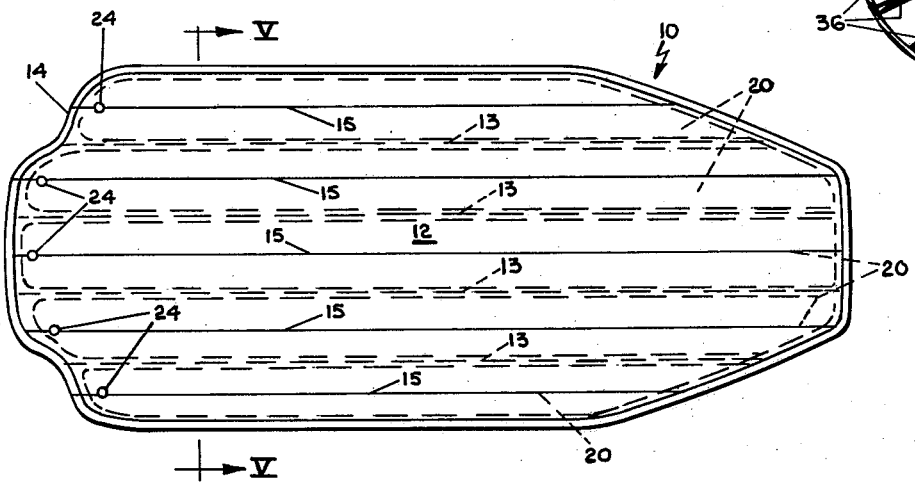
FIG. 2 is a plan view of the inflatable mattress of FIG. 1 illustrating the separate, inflatable envelopes or tubes therewithin.
Figure 5:
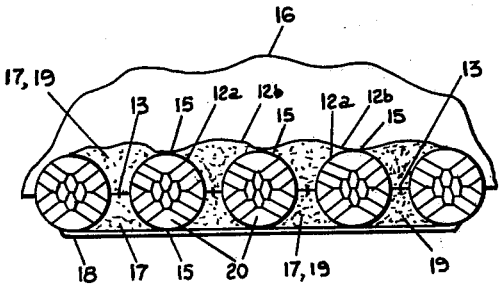
FIG. 5 is a sectional end view of the inflatable mattress taken along plane V—V of FIG. 2.

With reference to FIGS. 1, 2 and 5, insulated mattress embodiment 10 includes a flexible, enclosing cover 12 formed from woven fabric of natural or synthetic fibers which may or may not be waterproofed. Fitted within the enclosing cover are a series of any of the embodiments of inflatable, generally cylindrical insulating envelopes or tubes 20, 50, 55 or 60 which will be more fully described hereinafter. FIG. 5 specifically shows tubes 20. Envelopes 20 are inserted by means of an opening at one end of the cover which is closeable by means of a zipper 14, a plurality of snaps or other closure apparatus. The tubes are of varying lengths so that the mattress is configured more or less to the shape of a person with sufficient room to provide adequate sleeping area. The cover 12 may also incorporate a releasable over-cover 16 which is secured along the side and foot edges of the mattress by means of a zipper, snaps or other closures, as well as a waterproof shield 18 secured to the underside of the cover to prevent moisture from being transmitted from the mattress support surface to the person sleeping thereon.

Insulating tubes 20, 50, 55, or 60 are inflated and inserted side by side within the individual cover compartments. These compartments are formed by an inner layer 12*a* of the cover 12 by sewing the inner layer along its intire length at seams 13 spaced at suitable intervals across the width of the inner cover 12*a*. Cover 12 also includes an outer layer 12*b*, as shown in FIG. 5, with the inner and outer layers being sewn together at seams 15 at the top and bottom along the length of the cover generally centrally intermediate seams 13. Seams 13, 15 and cover layers 12*a*, 12*b* define elongated compartments or pockets 17 extending along the length of the cover into which is placed or filled additional compressible insulation material 19 such as waterfowl down, fiber batting, or polymer foam. The additional insulation material fills the voids or clefts between the tubes 20 and provides extra insulation reducing heat transfer between the upper and lower surfaces of the mattress or insulating apparatus.

Each of the inflatable, insulating apparatuses and more specificaly, the inflatable, fluid-tight envelopes or enclosures 20 is formed in the shape of an elongated, hollow tube having the shape of a right, circular cylinder with the ends closed so as to be impermeable to the filling fluid. Tube 20 includes wall portions 22 formed from a fluid impermeable material such as rubberized fabric, sheet plastic or the like. Typically, the walls are flexible so as to be easily folded or rolled when deflated by sufficiently resilient to resist puncturing or collapse. Also included is a valve 24 or other structure for inserting fluid and typically air within the tube.

Fitted within and secured to the interior of walls 22 of tube or cylinder 20 are a plurality of reflectorized baffles 36, in this case interconnected with one another and walls 22 to form an assembly having the cross-sectional shape of a honeycomb. At the center of the tube the baffles 36 are secured together to form four elongated, generally hexagonally shaped, closed cells or units 36*a*, 36*b*, 36*c* and 36*d*. Around these cells, generally planar baffle elements 36 extend outwardly into engagement with the interior surface walls 22 from the free corners of those hexagonal units.

Figure 9:
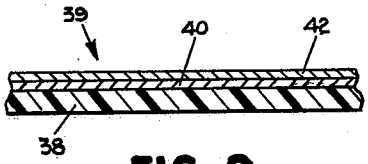
FIG. 9 is a sectional view of area IX in FIG. 6 illustrating one form of the reflectorized baffle material.
Figure 10:
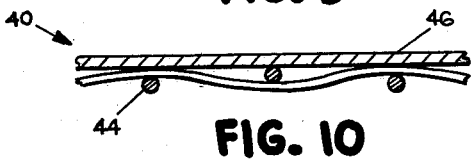
FIG. 10 is a sectional view taken similarly to FIG. 9 but showing an alternative baffle material.

As shown in FIGS. 9 and 10 the material used to form baffles 36 is a thin, flexible, resilient, substrate material which is either impermeable or permeable to fluid, either of which is effective to reduce convection currents. The material includes, on at least one surface thereof, a thin layer of metallic or other reflective material such as aluminum, silver, chromium, or alloys thereof or other metals of sufficient density to reflect a significant portion of any thermal radiation incident thereon. Usually, the amount of radiation reflected is more than one-half and preferably 90 per cent or more of the amount incident thereon.

In material embodiment 39 shown in FIG. 9, the substrate is formed from a thermoplastic material 38 such as Mylar, polystyrene polyvinyl chloride, cellophane, acetate, or vinyl of sufficiently thin thickness to be flexible. The metallic reflective layer 40 is a metallic foil sheet bonded to the substrate layer or, more typically, is a deposit coating of the metal or alloy which is very thin but sufficiently dense to reflect the abovementioned radiation. Such a coating may typically be provided as by sputtering from a heated element in a vacuum or by other methods. It is also possible, but not absolutely necessary, to provide a thin, transparent top coat 42 of organic material over the metallic layer 40 (FIG. 9) to prevent oxidation of that layer which would reduce the efficiency of the reflective layer.

Alternatively, the baffle material may comprise a material embodiment 45 (FIG. 10) including woven fabric 44 of natural or synthetic fibers to which is applied the metallic layer 46 in the form of a metallic foil sheet adhered to the fabric or a deposit coating applied thereon. The woven fabric has been found desirable because of its high flexibility and quietness in order to reduce to a minimum the rustling noises which may occur with other types of materials when a person moves during his sleep.

Figure 3:
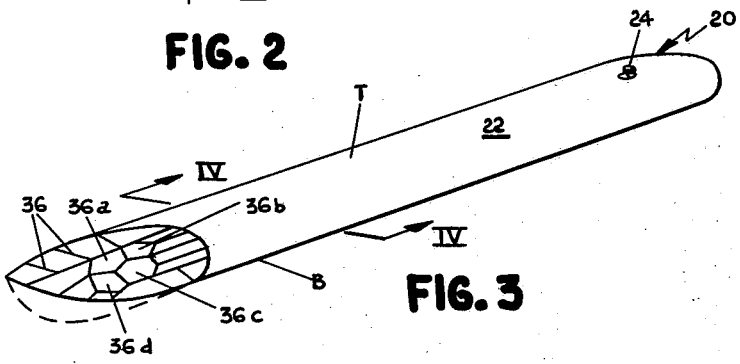
FIG. 3 is a perspective view of one of the inflatable envelopes or tubes of the inflatable mattress shown in FIGS. 1 and 2 shown partially in cross section.

Referring again to FIG. 4, the baffle materials 36 may be secured together in the honeycomb assembly and to the interior of the tube 20 along elongated seams by suitable means such as adhesive bonding or heating and fusing the layers to one another or the walls 22 depending on the type of material being used. The bonded seam portions extend substantially the entire length of the tube 20 (FIG. 3) with the ends of the baffle materials being left unbonded from walls 22 so that air may pass from the valve 24 around the ends of the baffle materials and into each elongated cell formed by the baffles. Such end fluid passageways do not, however, greatly reduce the effectiveness of the baffles in reducing convective heat transfer between the top T and bottom B of the tubes.

Figure 4:
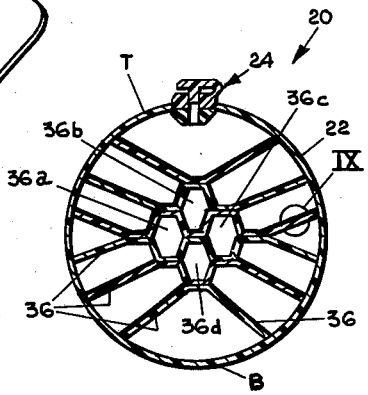
FIG. 4 is a sectional end view of the inflatable tube or envelope taken along plate IV—IV of FIG. 3 and illustrating the honeycomb baffle assembly therewithin.

The reflectorized baffle material, when formed into the plurality of cells or units as shown provides a dual insulating function. First, the plural reflective surfaces which, as shown in FIG. 4, generally upwardly toward the top surface T of the mattress or tube intended to support the person lying thereon, will reflect the thermal radiation emitted by the person's body sleeping thereon. Such reflection will greatly reduce the downward and somewhat lateral escape of the radiation or body heat and reduce radiative heat transfer to the supporting surface for the mattress. Secondly, each of the baffle cells formed by the honeycomb structure reduces convective fluid circulation of both the free and forced nature. Free convection is reduced because fluid circulation between the cold or lower bottom surface of the tube or envelope and the warmer, upper surface of the envelope which supports the person sleeping thereon is reduced or prevented. Forced convection, due to the mixing of air and the passage of fluid at a temperature different from that of the enclosing surfaces caused when the supported person moves or otherwise flexes the insulating apparatus is also reduced or prevented. Accordingly, the reflectorized baffle serves to reduce both radiative and convective heat transfer through the apparatus thereby effectively insulating the supported person from the colder ground therebeneath.

When the tube 20 is deflated by opening the valve 24, air escapes from each of the insulating cells between the baffle materials and the ends of the tube. The flexible nature of the baffle material itself allows the honeycomb assembly to collapse as the flexible walls 22 of the tube collapse thereby allowing the entire structure to lie flat when deflated. This, of course, greatly enhances the ability to store and transport the inflating apparatus.

Figure 6:
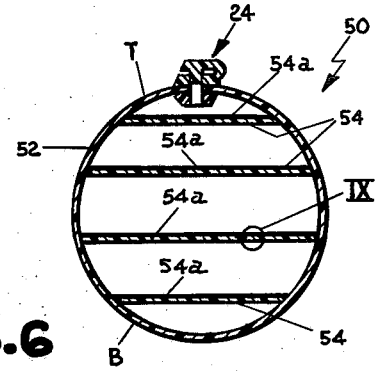
FIGS. 6, 7 and 8 are sectional end views of alternative embodiments of the inflatable tube or envelope such as is illustrated in FIG. 3 which figures illustrate three separate alternative baffle arrangements within the tubes.
Figure 7:
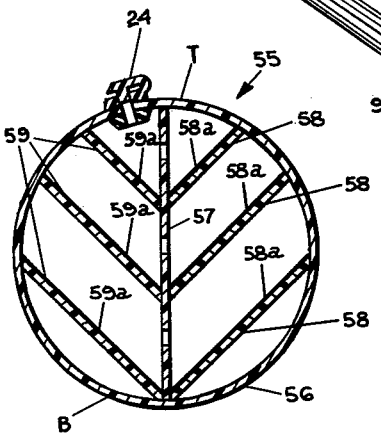
Figure 8:
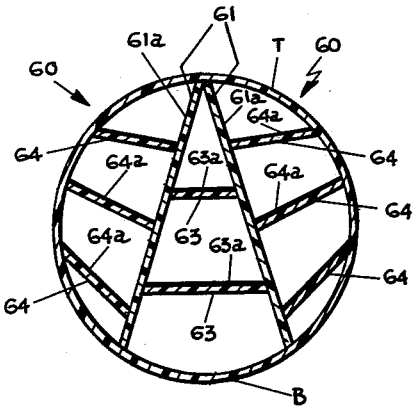

Alternative baffle arrangements within the tube-type envelopes are shown in FIGS. 6, 7 and 8. In FIG. 6, embodiment 50 of the inflatable, insulating tube or cylinder includes a series of four elongated, generally planar baffles 54 spaced apart and extending generally horizontally between the interior surfaces of side wall portions 52. These baffles may also be located at an angle to the top and bottom of the tube. Baffles 54 are formed from materials 39 or 45 (FIGS. 9 and 10), are generally parallel to one another, and are bonded or secured to the interior of the tube in the manner described above in connection with FIG. 4. The ends of the baffles 54 are left free to allow air from valve 24 to enter each of the chambers between the baffles. Alternately, one end of the baffles may be secured to the enclosing tube and the other end left free or perforations may be provided through the baffles in selected areas which would not otherwise reduce the effectiveness of the baffles in reducing conductive heat transfer. Reflective layers 54a are provided on each of the baffles generally facing the top portion T of the tube so as to reflect thermal radiation back toward any person supported on the top surface. The chambers between the baffles serve to reduce convective heat transfer as described above.

In FIG. 7, envelope or tube embodiment 55 includes reflectorized baffles 58, 59 extending at an angle to the top portion T. Baffles 58, 59 extend between portions of the inner surface of wall 56 and a generally vertical partition or divider 57 formed from a material such as that used for walls 56. The partition 57, like the baffle members 58, 59, may be left free at the ends of the tube to allow air from valve 24 to enter all of the chambers between the various baffles. Alternatively, baffle 57 may include perforations for fluid passage at selected areas. The surfaces of baffles 58, 59, which are generally closer to top portion T, include the reflective layers 58a, 59a to reduce radiative heat transfer. The several chambers between the baffles serve to reduce convective heat transfer as mentioned above.

In FIG. 8, tube embodiment 60 includes a pair of baffles 61 forming an inverted V which is generally vertically oriented and extends between opposing portions of the flexible tube walls 62. Intermediate top T and bottom B attachments of baffles 61, a pair of generally horizontally spaced baffles 63 extend between and are attached to baffles 61. Also, two sets of three additional, spaced baffles 64 are secured to baffles 61 and extend generally laterally to either side of the inverted V and upwardly to the tube walls 62 to which they are also secured. The generally upward facing surfaces of baffles 61, 63, and 64 have reflectorized layers **61*a*, 63*a*, and 64*a* as described above in connection with FIGS. 4, 6, and 7** to reduce radiative heat transfer while the chambers therebetween reduce convective heat transfer in the same sense as is described above.

Figure 11:
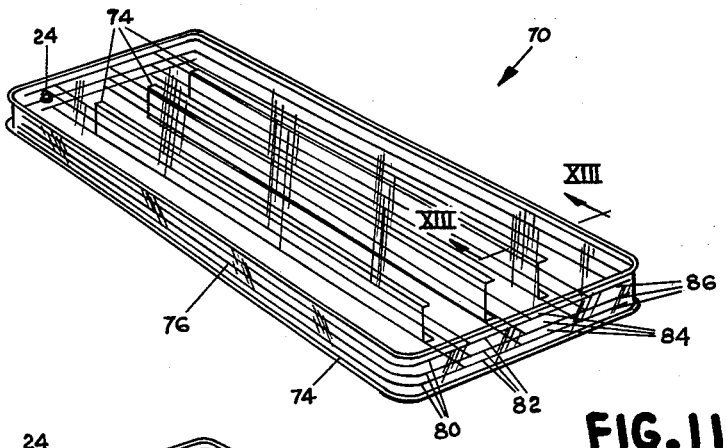
FIG. 11 is a perspective view of a second type of inflatable mattress embodying the present invention and being formed in the more conventional box-type construction.
Figure 12:
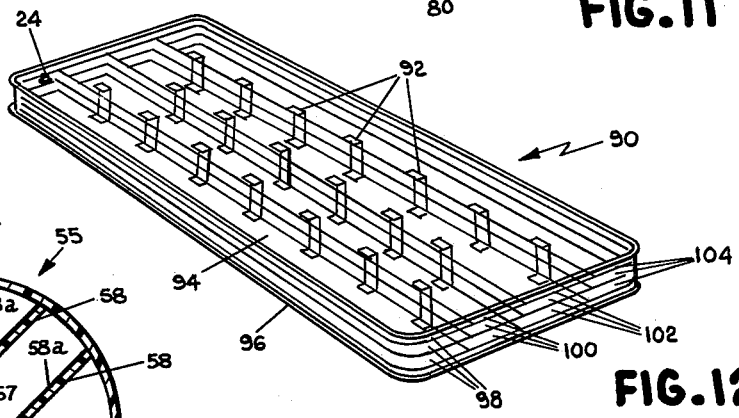
FIG. 12 is a perspective view of a third type of inflatable mattress embodying the present invention and being constructed in the more conventional tufted construction.
Figure 13:
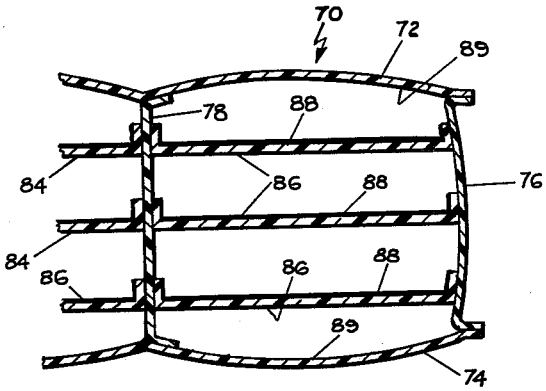
FIG. 13 is a fragmentary, sectional view of the reflective means and baffle means within the mattress of FIG. 11 taken along plane XIII—XIII of FIG. 11.

Alternative constructions for the insulating apparatus or fluid-filled mattress are shown in FIGS. 11-13. In FIG. 11, the fluid-tight envelope embodying the present invention is formed in the shape of a rectangular box or fluid-tight chamber 70. Insulated mattress 70 includes top and bottom walls 72, 74 respectively and side walls 76 extending and sealed therebetween at the edges of the top and bottom walls. Spaced across the width of the mattress 70 and extending generally the entire length of the mattress are a series of generally vertical reinforcing baffles, partitions, or dividers 78 which are secured by bonding or heat fusion, depending on the type of material used, between the interior surfaces of the top and bottom walls 72, 74. These partitions prevent the top and bottom walls from overexpanding during inflation. In addition, the dividers serve to provide securing means to which are attached elongated reflectorized baffle strips 80, 82, 84, and 86. These strips are spaced vertically over the entire thickness of the mattress and secured to one another at their edges and between partitions 78 and/or side walls 76.

As is best shown in FIG. 13, each of the reflectorized baffles 86 includes a reflective layer 88 generally facing the top or upper surface 72 to reduce radiative heat transfer as described above. In addition, the interior surface of top and bottom walls 72, 74 includes reflective layers 89 which additionally serve to reduce radiative heat transfer. Walls 72, 74 are typically thicker, tougher, and more resilient than baffles 86 which are formed from reflectorized plastic or fabric such as described above in connection with FIGS. 9 and 10. Baffles 86, partitions 78, top and bottom walls 72, 74, and side walls 76 may all be secured together via adhesive or heat bonding depending on the type of material used. A valve 24 is included at one corner of the mattress 70 such that the entire mattress may be inflated from one position. As with the tube embodiments 20, 50, 55 and 60 described above, partitions 86 may be left free at their ends to allow air to pass from single valve 24 to all compartments therebetween or perforations at spaced locations may be provided between the baffles at selected areas. Such perforations will not effectively reduce the efficiency of the baffles to reduce conductive heat transfer as described above.

Mattress embodiment 90 is generally similar to embodiment 70 except that it is formed using the conventional tufted construction including spaced strips or tufts 92 of material extending internally between the top and bottom walls 94, 96. Strips 92 prevent overinflation of the top and bottom walls and also serve to secure the enlongated, reflectorized baffle strips 98, 100, 102, 104 which are spaced through the thickness of the mattress in the same manner as in mattress 70. In either embodiment 70 or 90, the strips 80, 82, 84, 86 or 98, 100, 102, 104 may be secured together along their lateral edges of the adjacent strip in the same plane intermediate the tuft 92 and side walls 95 or partition 78 and side walls 76. In mattress 90, the upper surfaces of baffles 98, 100, 102, 104 as well as the inside surfaces to top and bottom walls 94, 96 are reflectorized to reduce radiative heat transfer while the baffles form the chambers or units which reduce convection heat transfer as is described above.

Figure 14:
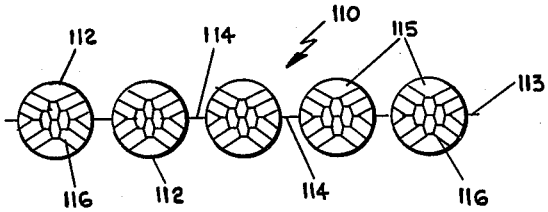
FIG. 14 is a sectional view of a fourth type of inflatable mattress embodying the present invention and being constructed with an outer wall formed of two sheets of material sealed together in a more conventional manner.

Mattress embodiment 110 shown in FIG. 14 includes top and bottom walls 112 sealed to one another around their entire periphery by a seam 113 and also sealed to one another along spaced, lengthwise seams 114 which extend along a major portion of the length of a mattress, and may or may not connect to seam 113. Seams 113 and 114 define a series of longitudinal fluid chambers 115 which assume generally cylindrical configurations when the mattress is inflated. Within each such chamber 115 is located an array of reflective baffles 116 as previously described and as shown in FIGS. 4, 6, 7 and 8. Generally upward facing reflective layers on these baffles reflect thermal radiation back toward any person supported on the top surface, as described above. The cellular nature of the baffle array further serves to reduce free and forced convective heat transfer between the top and bottom surfaces of the mattress, as previously described.

It will be understood that in its broader aspects, the insulating apparatus is functional to reduce heat transfer thereacross by including at least two spaced layers of reflective material on spaced portions or surfaces of an inflatable envelope or cover therefor such as cover 12 even without the inclusion of any baffle structure between those portions. For instance, with reference to FIG. 13, the present invention would be functional to reduce radiative heat transfer across the envelope 70 if partitions 86 were eliminated and only reflective layers 89 included. Similarly, reflective layers 89 could be eliminated with the inclusion of baffles 86 having reflective layers 88 thereon serving to reduce radiative heat transfer. Such a structure would be similar to that shown in FIGS. 4, 6, 7, and 8. Also, the reflective layers could be on the inside or outside surfaces of the apparatus.

It will also be understood that convective heat transfer could be reduced across the apparatus by including baffle structure of the type shown in FIGS. 4, 6, 7, 8 and 13 without the inclusion of any reflective layers thereon. Such baffles would isolate fluid chambers to reduce the mixing and circulation of air or the other fluid inflating the structure causing such convection. Of course, the efficiency of the reduction in heat transfer is increased by combining the effects of the reflective layers and baffle structure to form reflectorized baffles as has been described above in connection with several embodiments of the invention.

Accordingly, the present invention provides an inflatable insulation apparatus which reduces radiative and/or convective heat transfer across the apparatus. A specific application in which the apparatus has been found useful is in inflatable mattresses used for use by campers, hikers, and other outdoorsmen in the order to prevent heat transfer between a colder ground or other supporting surface for the mattress and the body of the person supported thereon. The same principles as described above may, of course, be applied to permanently sealed, fluid-filled envelopes as well as to the selectively inflatable and deflatable envelopes described herein.

While several forms of the invention have been shown and described, other forms will now be apparent to those skilled in the art. Therefore, it will be understood that the embodiments shown in the drawings and described above are merely for illustrative purposes and are not intended to limit the scope of the invention which is defined by the claims which follow.

The embodiment of the invention in which an exclusive property or privilege is claimed are defined as follows:

1. An inflatable insulating apparatus for use as or in a mattress inflatable with a fluid comprising a plurality of fluid-tight envelopes; means for inserting a fluid therewithin to inflate said envelopes; and reflective means included on at least two spaced portions of each of said envelopes for reflecting a significant portion of the thermal radiation incident thereon, said two spaced portions including said reflective means being in general alignment with and opposing one another across at least a portion of each of said fluid-tight envelopes, each spaced portion including said reflective means intersecting a path extending between a first surface of each of said envelopes adapted to engage a first object, person or the like being insulated and a second surface of each of said envelopes adapted to engage a second object, surface or the like from which the first object, person or the like is being insulated, whereby said apparatus in an insulator with heat transfer through and across said envelopes being reduced by said spaced reflective means; said envelopes located adjacent one another; said apparatus including additional insulation material covering at least a portion of the exterior of each of said envelopes to facilitate the reduction in heat transfer through said apparatus; and a cover retaining said envelopes and additional insulation material together.

2. The insulating apparatus of claim 1 including wall means forming said envelopes and at least one baffle extending between portions of said wall means for reducing convective heat transfer between said spaced, opposing portions of said envelopes; said reflective means being included on at least one surface of said baffle and a portion of said wall means.

3. The insulating apparatus of claim 2 wherein said baffle is spaced from said portion of said wall means including said reflective means.

4. The insulating apparatus of claim 3 including a plurality of spaced baffles, said reflective means being included on each of said baffles.

5. The insulating apparatus of claim 4 wherein said baffles are each formed from thin, flexible material including a layer of metallic material on at least one surface thereof.

6. The insulating apparatus of claim 5 wherein said thin, flexible material is a plastic film.

7. The insulating apparatus of claim 5 wherein said thin, flexible material is a fabric.

8. The insulating apparatus of claim 1 wherein each of said envelopes includes at least one baffle extending between said spaced portions thereof and located to separate each of said envelopes into at least two fluid areas to reduce convective heat transfer between said fluid areas of said envelopes.

9. The insulating apparatus of claim 1 wherein each of said envelopes includes a plurality of baffles secured therewithin, said baffles being spaced from said spaced portions of each of said envelopes to define a plurality of fluid areas which reduce convective heat transfer through said envelopes.

10. The insulating apparatus of claim 9 wherein said baffles are generally parallel to one another.

11. The insulating apparatus of claim 9 wherein said baffles are interconnected with one another and with their respective envelope and form the cross-sectional shape of a honeycomb, said honeycomb baffle structure being collapsible to lie generally flat when said apparatus is deflated.

12. The insulating apparatus of claim 1 wherein each of said envelopes includes a baffle extending therewithin; internal securing means extending between said spaced portions of each of said envelopes for securing said portions to prevent inflation beyond a predetermined distance, said baffle being secured to at least a portion of said internal securing means.

13. The insulating apparatus of claim 1 including two layers of sheet material secured together at spaced intervals to form said plurality of fluid tight envelopes; each of said envelopes including at least one baffle extending therewithin.

14. The insulating apparatus of claim 1 including a plurality of spaced baffles secured within said envelope, at least one surface of one of said baffles having said reflective means thereon.

15. The inflatable insulating apparatus of claim 1 wherein said envelopes each include a plurality of baffle means for reducing convective heat transfer between surfaces of said envelopes, said baffle means being interconnected with one another and the outer walls of said respective envelopes to provide a baffle assembly having a cross-sectional shape of a honeycomb, said honeycomb baffle assembly being collapsible such that it will lie generally flat when said apparatus is deflated.

16. The insulating apparatus of claim 15 wherein at least some of said baffle means include reflective means for reflecting thermal radiation.

17. The insulating apparatus of claim 16 wherein said baffle means are each formed from thin, flexible material including a layer of metallic material on at least one surface thereof.

* * * * *

UNITED STATES PATENT AND TRADEMARK OFFICE

CERTIFICATE OF CORRECTION

PATENT NO. : 4,092,750

DATED : June 6, 1978

INVENTOR(S) : Donald G. Ellis

It is certified that error appears in the above-identified patent and that said Letters Patent are hereby corrected as shown below:

Column 2, line 15, "Thses" should be -- These --.
Column 2, line 30, "plate" should be -- plane --.
Column 3, line 28, "intire" should be -- entire --.
Column 3, line 52, "by" should be -- but --.
Column 4, line 53, "4, generally" should be -- 4, face generally --.
Column 6, line 65, "convection" should be -- convective --.
Column 7, line 66, "embodiment" should be -- embodiments --.
Column 8, line 17, "in an" should be -- is an --.

Signed and Sealed this

*Fourteenth* Day of *August 1979*

[SEAL]

*Attest:*

*Attesting Officer*

LUTRELLE F. PARKER

*Acting Commissioner of Patents and Trademarks*